US008139975B2

(12) United States Patent
Hayashida et al.

(10) Patent No.: US 8,139,975 B2
(45) Date of Patent: Mar. 20, 2012

(54) SEALING MEMBER AND PROCESS CARTRIDGE

(75) Inventors: Makoto Hayashida, Susono (JP); Nobuharu Hoshi, Numazu (JP); Akira Suzuki, Naka-gun (JP); Emi Watanabe, Suntou-gun (JP); Kenji Aoki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 324 days.

(21) Appl. No.: 12/634,582

(22) Filed: Dec. 9, 2009

(65) Prior Publication Data

US 2010/0150604 A1 Jun. 17, 2010

(30) Foreign Application Priority Data

Dec. 12, 2008 (JP) ..... 2008-316881

(51) Int. Cl.
*G03G 15/08* (2006.01)

(52) U.S. Cl. ..... 399/102; 399/103; 399/105

(58) Field of Classification Search ..... 399/102, 399/103, 105
See application file for complete search history.

(56) References Cited

FOREIGN PATENT DOCUMENTS

JP 11-272071 A 10/1999

*Primary Examiner* — David Gray
*Assistant Examiner* — Erika J Villaluna
(74) *Attorney, Agent, or Firm* — Canon U.S.A., Inc., IP Division

(57) ABSTRACT

Provided is a sealing member for preventing leakage of a developer from a developer containing portion of a process cartridge detachable from a main body of an electrophotographic image forming apparatus to an outside of the developer containing portion. The sealing member is made of a thermoplastic elastomer that contains at least a copolymer and a plasticizer. In a molecular weight distribution of a tetrahydrofuran soluble matter of the thermoplastic elastomer measured by gel permeation chromatography, at least one peak is present in each of a region of a molecular weight of 4,000 or less and a region of a molecular weight of 30,000 to 200,000, and a percentage of a component of a molecular weight of 800 or less in a region of a molecular weight of 5,000 or less is 30% or less.

6 Claims, 13 Drawing Sheets

SEALING MEMBER AND PROCESS CARTRIDGE

BACKGROUND OF THE INVENTION

1. Field of the Invention

The present invention relates to a sealing member for use in a process cartridge detachable from an electrophotographic image forming apparatus for forming an image on a recording medium. The present invention also relates to a process cartridge using the sealing member.

A typical process cartridge is a cartridge in which an electrophotographic photosensitive drum and at least one of a charging unit, a developing unit, and a cleaning unit are integrally formed, and it is detachable from a main body of an image forming apparatus. In the present invention, a developer containing portion is a necessary element. Therefore, a process cartridge that includes a developer containing portion is discussed.

An electrophotographic image forming apparatus is one that forms an image on a recording medium using the electrophotographic image forming technique. Examples of the electrophotographic image forming apparatus include, but not limited to, an electrophotographic copier, an electrophotographic printer (e.g., a laser beam printer, a light-emitting diode (LED) printer), and a facsimile machine.

2. Description of the Related Art

Traditionally, an electrophotographic image forming apparatus employs a system of enabling a process cartridge in which an electrophotographic photosensitive member and a process unit that acts on the electrophotographic photosensitive member are unitized to be detachable from the main body of the image forming apparatus.

In such a process cartridge, in order to prevent leakage of a developer from a developer containing portion to the outside, a plurality of sealing members are disposed between frames constituting a process cartridge and parts. For example, in order to prevent leakage of a developer to the outside of a development frame in a process cartridge, a sealing member is disposed between a developer regulation member and the development frame.

One known example of a material of a sealing member is an elastic body, such as a urethane foam. A method of making the sealing member being deformed by a predetermined depression quantity come into contact with a sealing portion to seal against leakage of a developer is generally employed (see, for example, Japanese Patent Laid-Open No. 11-272071).

A urethane foam as a sealing member is typically attached on a development frame using double-sided adhesive tape provided on a substrate. When a developer regulation member is imposed in a state where the urethane foam is attached, the urethane foam being deformed by a predetermined depression quantity is thus inserted between the development frame and the developer regulation member. Accurately attaching the urethane foam using double-side adhesive tape requires much effort. Additionally, release paper from the double-sided tape is present as discarded material, so the amount of the discarded material increases with an increase in production.

To address this issue, the use of a thermoplastic elastomer in place of a urethane foam is being examined, and in particular, directly molding the thermoplastic elastomer into a sealing member on a development frame is being examined. If the thermoplastic elastomer is used, in order to prevent adverse effects of deformation of the development frame and the developer regulation member on the image quality, it is useful that resilience of the thermoplastic elastomer be minimized.

However, if the molecular weight is too lowered in order to reduce the hardness of the thermoplastic elastomer, a plasticizer contained in the thermoplastic elastomer may seep after it is left under high temperature conditions for a long period of time, toner particles may be fused together, and thus an image defect, such as a vertical line, may tend to occur in an image. Accordingly, it is desired that fusing toner particles together be reduced and the occurrence of an image defect, such as a vertical line, in an image be reduced.

SUMMARY OF THE INVENTION

The present invention provides a sealing member that enables image formation with no discarded material to be achieved with stable development and with virtually no loss of image quality, such as the one caused by a vertical line, even if it is left under high temperature conditions for a long period of time and also provides a process cartridge using such a sealing member.

According to an aspect of the present invention, a sealing member for preventing leakage of a developer from a developer containing portion of a process cartridge detachable from a main body of an electrophotographic image forming apparatus to an outside of the developer containing portion is provided. The sealing member is made of a thermoplastic elastomer that contains at least a copolymer and a plasticizer. In a molecular weight distribution of a tetrahydrofuran soluble matter of the thermoplastic elastomer measured by gel permeation chromatography, at least one peak is present in each of a region of a molecular weight of 4,000 or less and a region of a molecular weight of 30,000 to 200,000, and a percentage of a component of a molecular weight of 800 or less in a region of a molecular weight of 5,000 or less is 30% or less.

According to another aspect of the present invention, a process cartridge detachable from a main body of an electrophotographic image forming apparatus includes a developer containing portion and a sealing member for preventing leakage of a developer from the developer containing portion to an outside of the developer containing portion. The sealing member is made of a thermoplastic elastomer that contains at least a copolymer and a plasticizer. In a molecular weight distribution of a tetrahydrofuran soluble matter of the thermoplastic elastomer measured by gel permeation chromatography, at least one peak is present in each of a region of a molecular weight of 4,000 or less and a region of a molecular weight of 30,000 to 200,000, and a percentage of a component of a molecular weight of 800 or less in a region of a molecular weight of 5,000 or less is 30% or less.

With the present invention, the use of a thermoplastic elastomer as a sealing member for preventing leakage of a developer from a development frame can provide the sealing member having no discarded material and exhibiting good sealing capability. Additionally, the sealing member can be provided that, even if it is left under high temperature and high humidity conditions for a long period of time, enables an image to be formed with stable development and with virtually no loss of image quality, such as the one caused by a vertical line or a fog.

Further features of the present invention will become apparent from the following description of exemplary embodiments with reference to the attached drawings.

DESCRIPTION OF THE EMBODIMENTS

A first embodiment of the present invention will be described below with reference to the drawings. However, it does not intend to limit the present invention. In the following description, the longitudinal direction of a process cartridge indicates a direction that crosses an attachment direction in which the process cartridge is attached to the main body of an electrophotographic image forming apparatus (the direction being substantially perpendicular to the attachment direction and being the direction of an axis of rotation of a photosensitive drum). The left and right of a process cartridge indicate the left and right thereof seen from an attachment direction in which the process cartridge is attached to the main body of an electrophotographic image forming apparatus. The top surface of a process cartridge indicates an upper surface thereof when the process cartridge is attached to the main body of an electrophotographic image forming apparatus. The bottom surface of a process cartridge indicates a lower surface thereof.

Configuration of Main Body of Image Forming Apparatus

Figure 1:
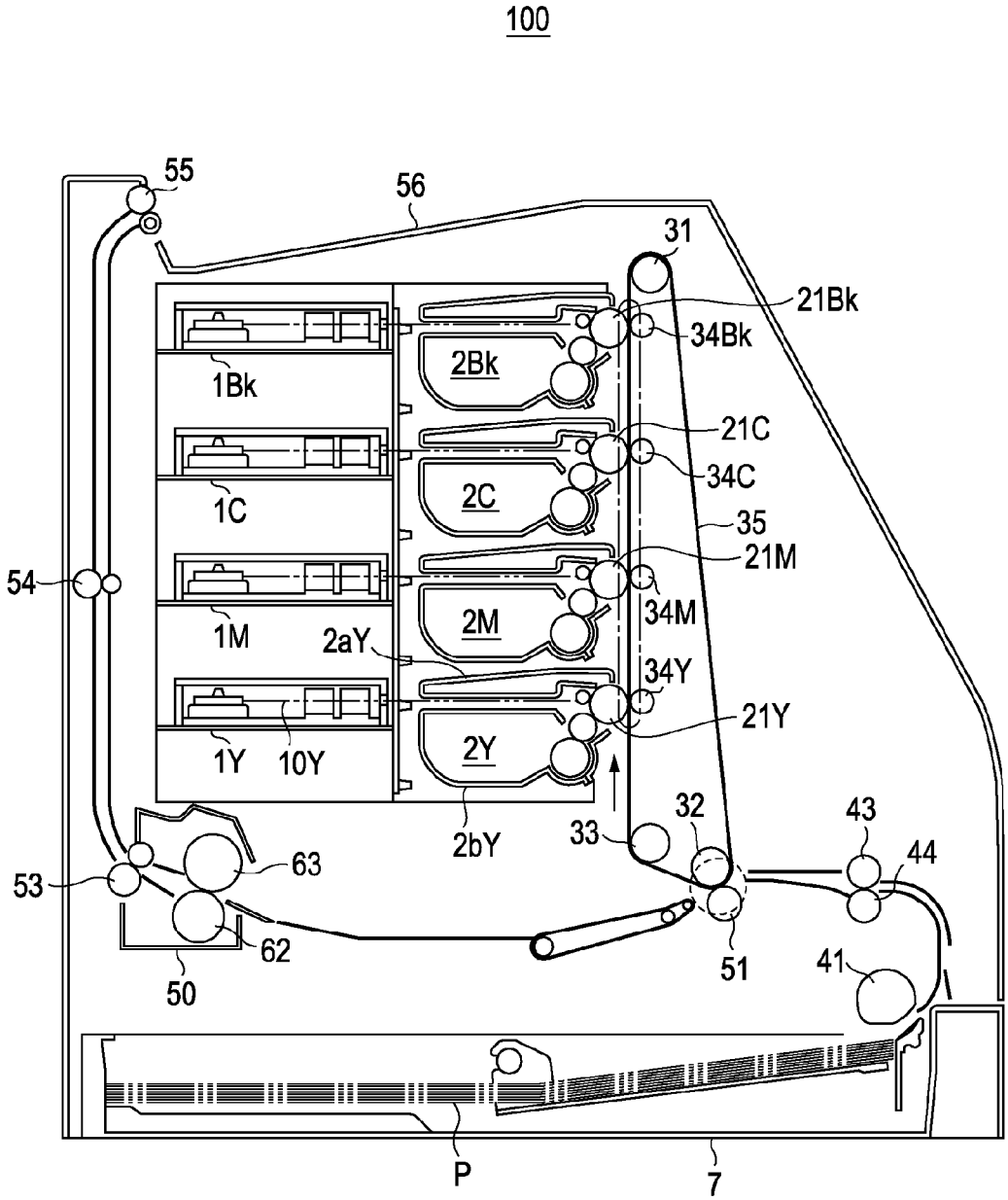
FIG. 1 is a schematic cross-sectional view that illustrates an overview configuration of an image forming apparatus.

First, a configuration of the main body of an electrophotographic image forming apparatus is described using FIG. 1. FIG. 1 is a schematic cross-sectional view of a color laser beam printer being one form of an image forming apparatus (hereinafter referred to as "main body of the image forming apparatus"). As illustrated in FIG. 1, the main body of the image forming apparatus 100 includes a process cartridge 2 (2Y, 2M, 2C, 2Bk) corresponding to yellow (Y), magenta (M), cyan (C), and black (Bk), an intermediate transfer member 35 configured to transfer a color image developed on an electrophotographic photosensitive drum 21 (21Y, 21M, 21C, 21Bk) to a transfer medium P, a group of rollers 31, 32, and 33 configured to stretch the intermediate transfer member therearound, a fixing portion 50 configured to fix the color image on the transfer medium P, and a group of discharge rollers 53, 54, and 55 configured to discharge the transfer medium P onto a discharge tray 56. The process cartridges 2Y, 2M, 2C, and 2Bk, which correspond to four colors Y, M, C, and Bk, are attached to the main body of the image forming apparatus 100 so as to be individually detachable therefrom.

Next, an operation of the main body of the image forming apparatus 100 is described below. First, a paper feed roller 41 is rotated and separates one transfer medium P in a paper feed cassette 7, and the transfer medium P is conveyed to registration rollers 43 and 44. The photosensitive drum 21 and the intermediate transfer member 35 are rotated to the direction indicated by the arrow illustrated in FIG. 1 at a predetermined peripheral speed V (hereinafter referred to as "process speed"). The surface of the photosensitive drum 21 is uniformly charged by a charging unit and then exposed by a laser beam 10 (10Y, 10M, 10C, 10Bk) from an exposure device 1 (1Y, 1M, 1C, 1Bk), and thus an electrostatic latent image is formed on the photosensitive drum 21. Simultaneously with the formation of the latent image, the latent image on the photosensitive drum 21 is developed by a developer borne on a developer bearing member of a development unit 2*b* (hereinafter referred to also as "toner"). The color images corresponding to Y, M, C, and Bk developed on the photosensitive drum 21 (21Y, 21M, 21C, 21Bk) are primarily transferred to the outer surface of the intermediate transfer member 35 by a transfer roller 34 (34Y, 34M, 34C, 34Bk). The color images transferred onto the intermediate transfer member 35 are secondarily transferred to the transfer medium P by a secondary transfer roller 51. After that, the images are fixed on the transfer medium P by the fixing portion 50 including a pressure roller 62 and a fixing roller 63. The transfer medium P on which the images are fixed is discharged onto the discharge tray 56 through the discharge rollers 53, 54, and 55. In such a way, the image forming operation is completed.

Configuration of Process Cartridge

Figure 2:
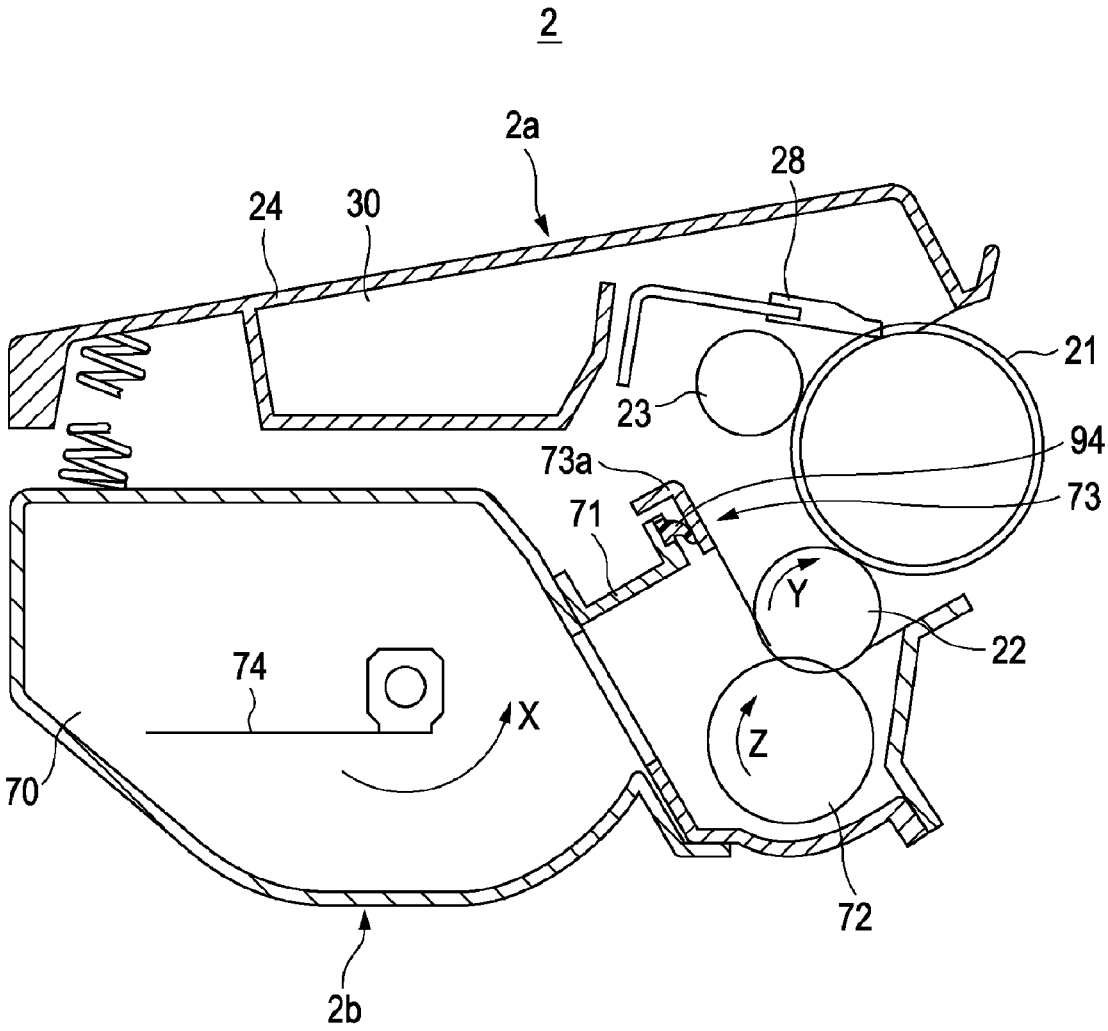
FIG. 2 is a schematic cross-sectional view that illustrates a process cartridge.

A configuration of the process cartridge 2 according to the first embodiment of the present invention is described below using FIG. 2. FIG. 2 is a schematic cross-sectional view of the process cartridge 2. The process cartridges 2Y, 2M, 2C, and 2Bk have the same configuration. The process cartridge 2 is made up of a photosensitive drum unit 2*a* and the development unit 2*b*.

In the photosensitive drum unit 2*a*, the photosensitive drum 21 is rotatably attached to a cleaning frame 24. A charging roller 23 being a primary charging unit configured to uniformly charge the surface of the photosensitive drum 21 and a cleaning blade 28 configured to remove a developer (toner) from the surface of the photosensitive drum 21 are disposed on the periphery of the photosensitive drum 21.

The development unit 2*b* is made up of a development roller 22 being the developer bearing member, a toner container 70 in which toner is accommodated, and a development chamber 71. The development roller 22 is rotatably supported by the development chamber 71. A toner supply roller 72 rotatable in contact with the development roller 22 in the direction indicated by the arrow Z and a developer regulation member 73 are disposed on the periphery of the development roller 22. A toner agitation mechanism 74 is disposed inside the toner container 70. A development blade seal 94 being a sealing member configured to prevent leakage of a developer (toner) from between the development frame and the developer regulation member 73 is disposed.

Figure 3:
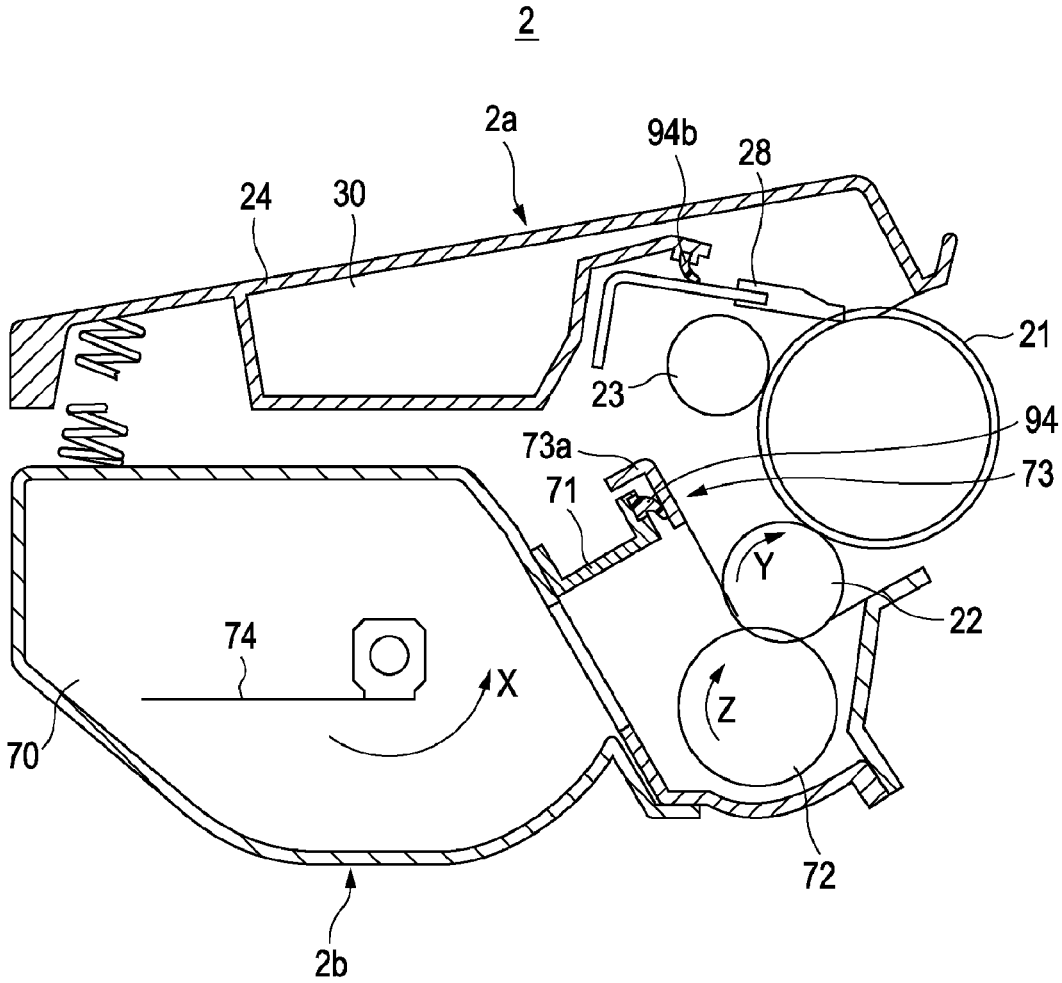
FIG. 3 is a schematic cross-sectional view that illustrates another process cartridge.

Next, an operation of the process cartridge 2 is described below. First, toner is conveyed to the toner supply roller 72 by the toner agitation mechanism 74. The toner supply roller 72 supplies the toner to the development roller 22 by being rotated in the direction indicated by the arrow Z illustrated in FIG. 2. The toner supplied onto the development roller 22 is made to reach the developer regulation member 73 by rotation of the development roller 22 in the direction indicated by the arrow Y. The developer regulation member 73 applies a predetermined amount of charge and regulates the thickness of the toner to form a thin toner layer. The toner regulated by the developer regulation member 73 is conveyed to a development portion in which the photosensitive drum 21 and the development roller 22 are in contact with each other, and the toner is subjected to development of an image on the photosensitive drum 21 by application of a development bias to the development roller 22. After the image developed using the toner is primarily transferred to the intermediate transfer member (35 in FIG. 1), toner remaining on the photosensitive drum is removed as waste toner by the cleaning blade 28. The removed waste toner is accumulated in a waste-toner room 30. FIG. 3 illustrates an apparatus in which a cleaning blade seal 94*b* is added to the configuration illustrated in FIG. 2. The sealing member according to the present invention can also be used in such a cleaning blade seal and an end seal of a roller.

Development Unit

Figure 4:
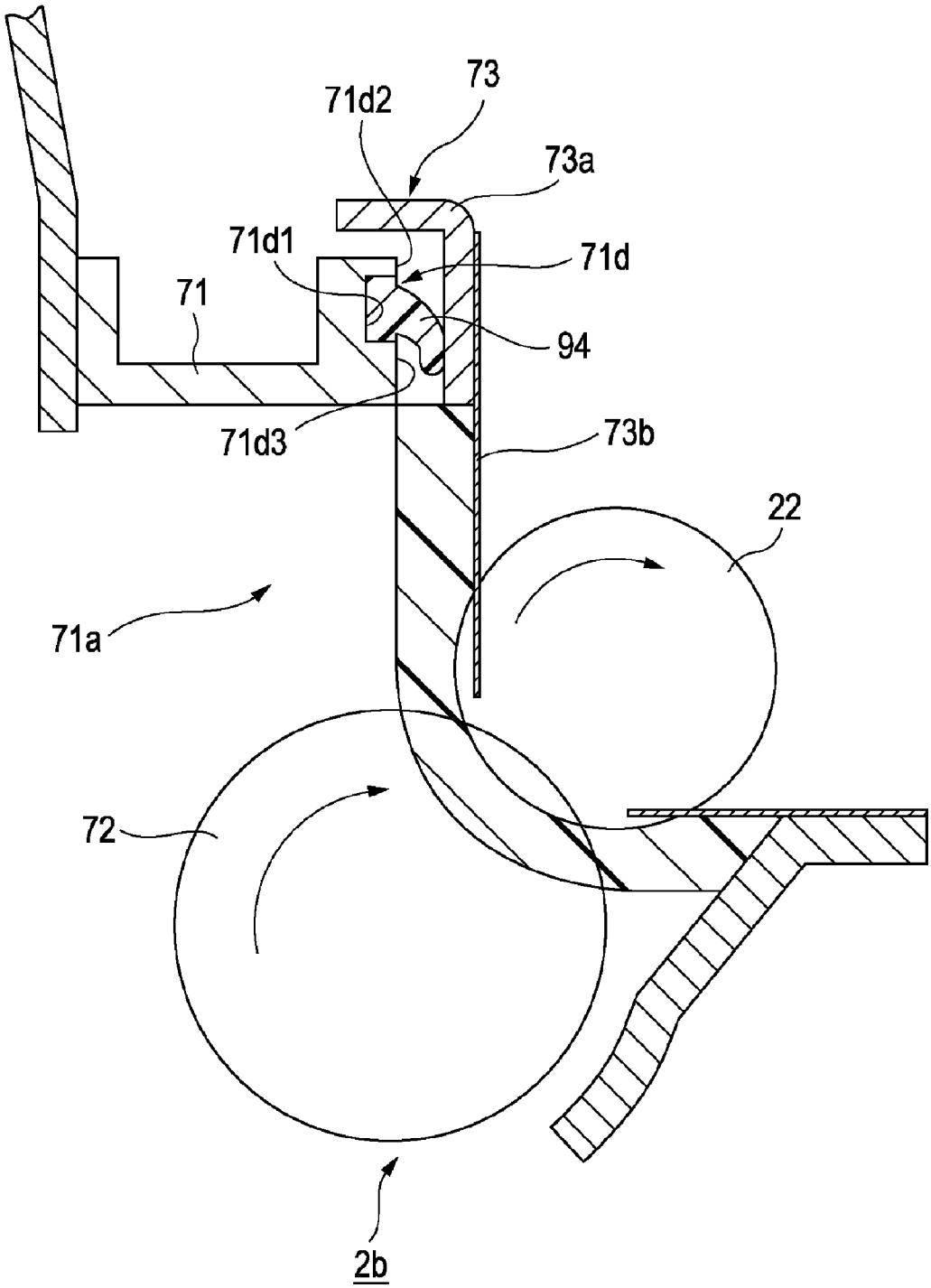
FIG. 4 is a schematic cross-sectional view that illustrates a development unit.
Figure 5:
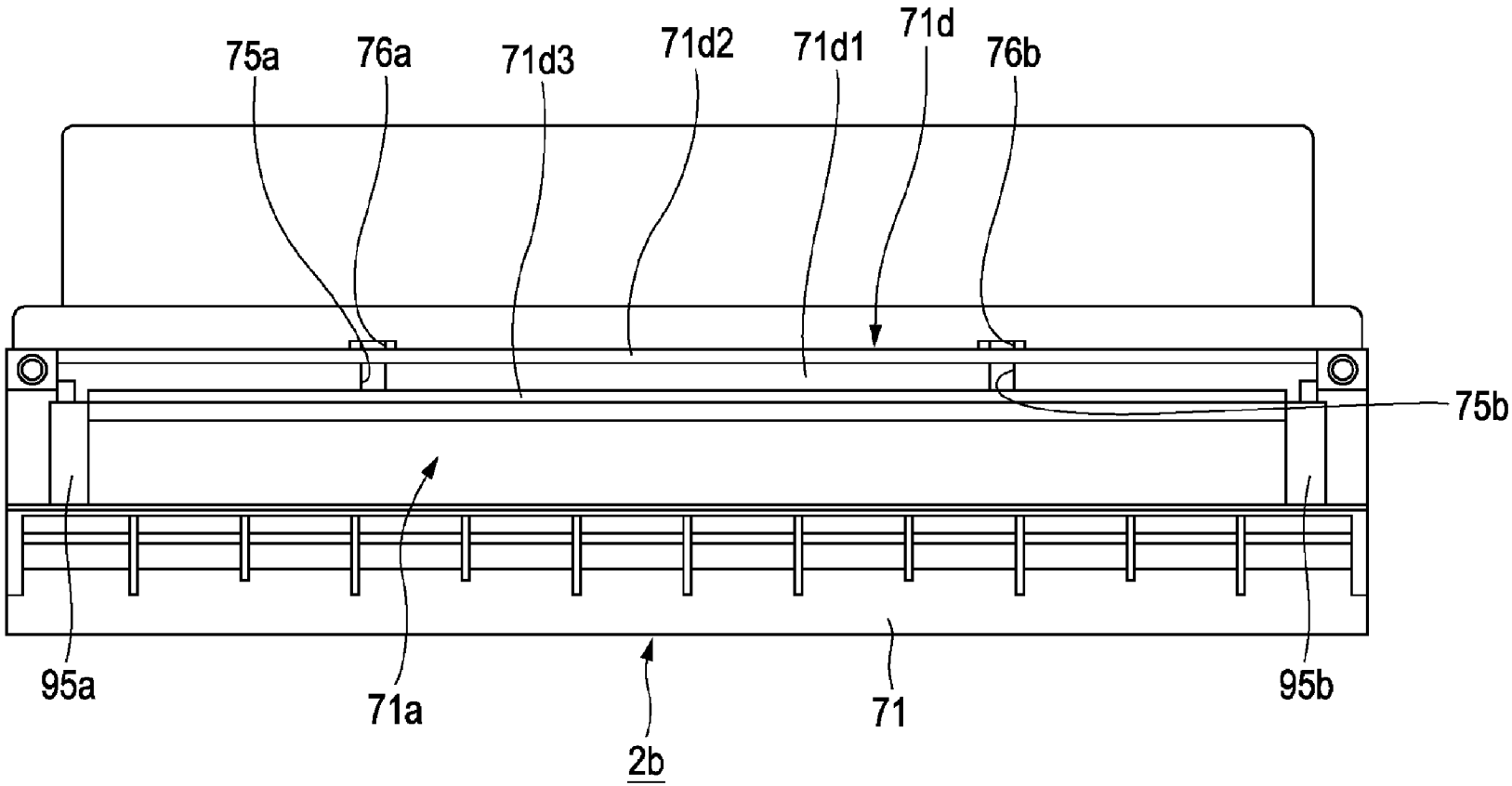
FIG. 5 is a schematic front view that illustrates a state before a development blade seal of the development unit is molded.
Figure 6:
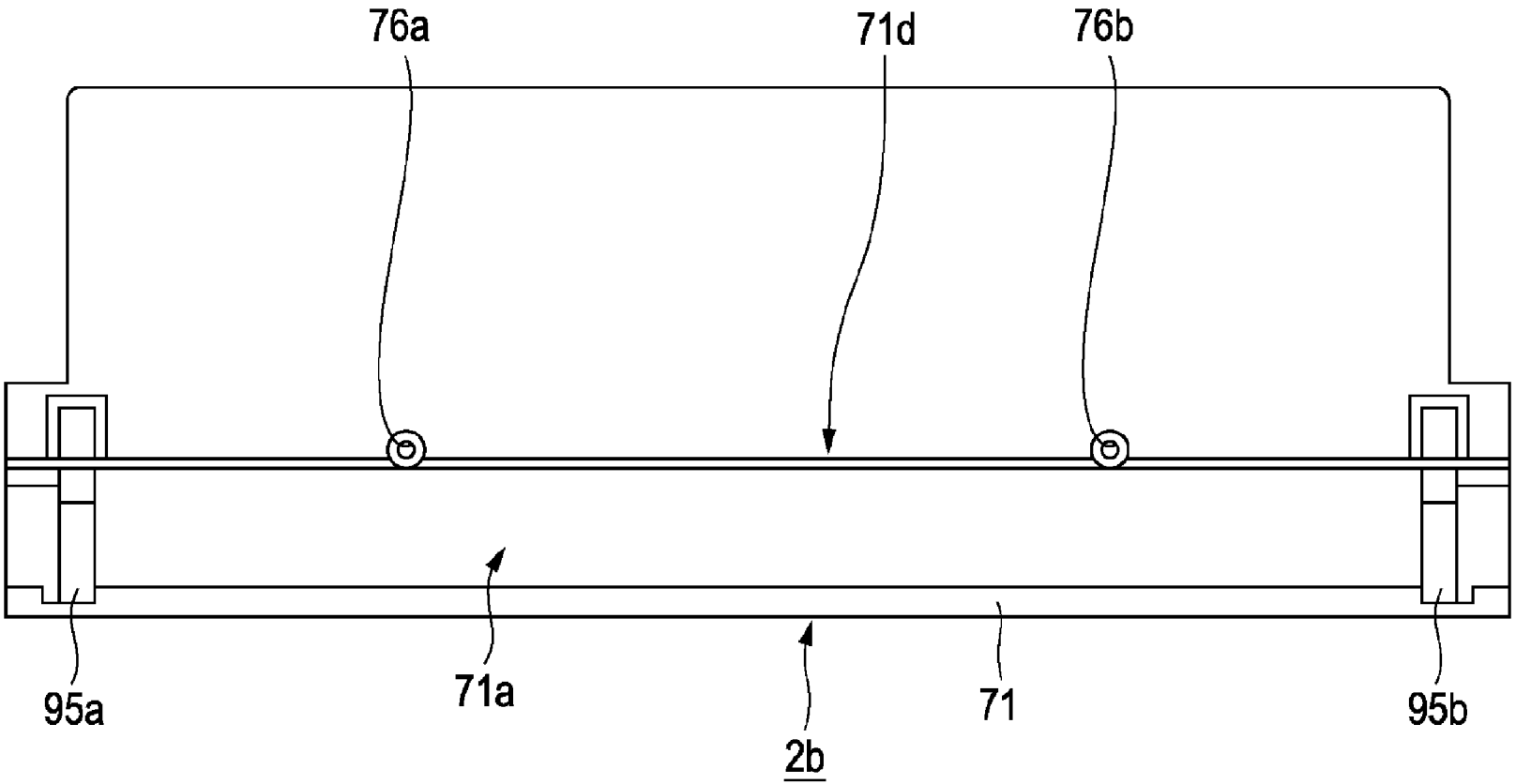
FIG. 6 is a schematic top view that illustrates a state before the development blade seal of the development unit is molded.
Figure 7:
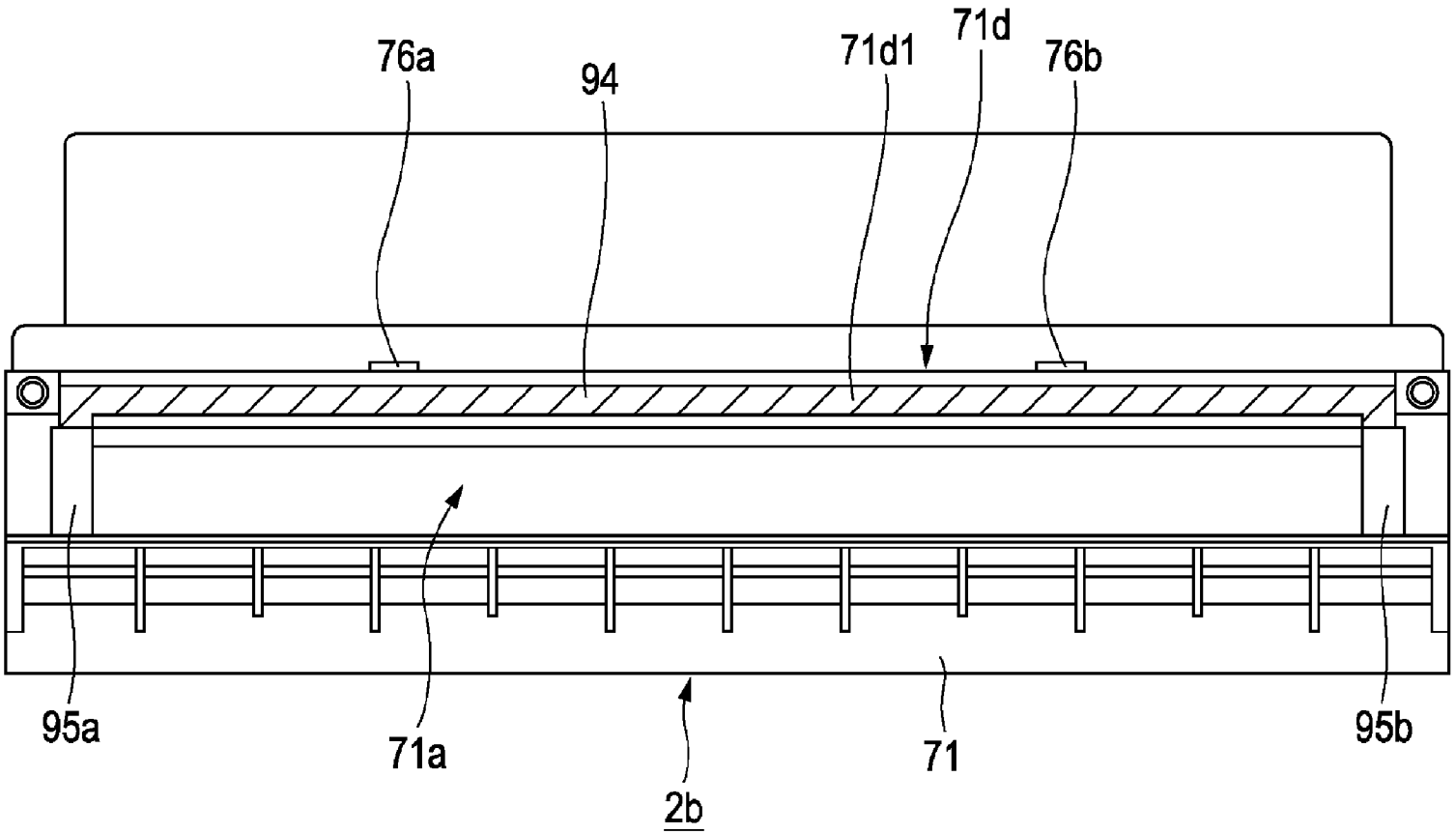
FIG. 7 is a schematic front view that illustrates a state after the development blade seal of the development unit is molded.
Figure 8:
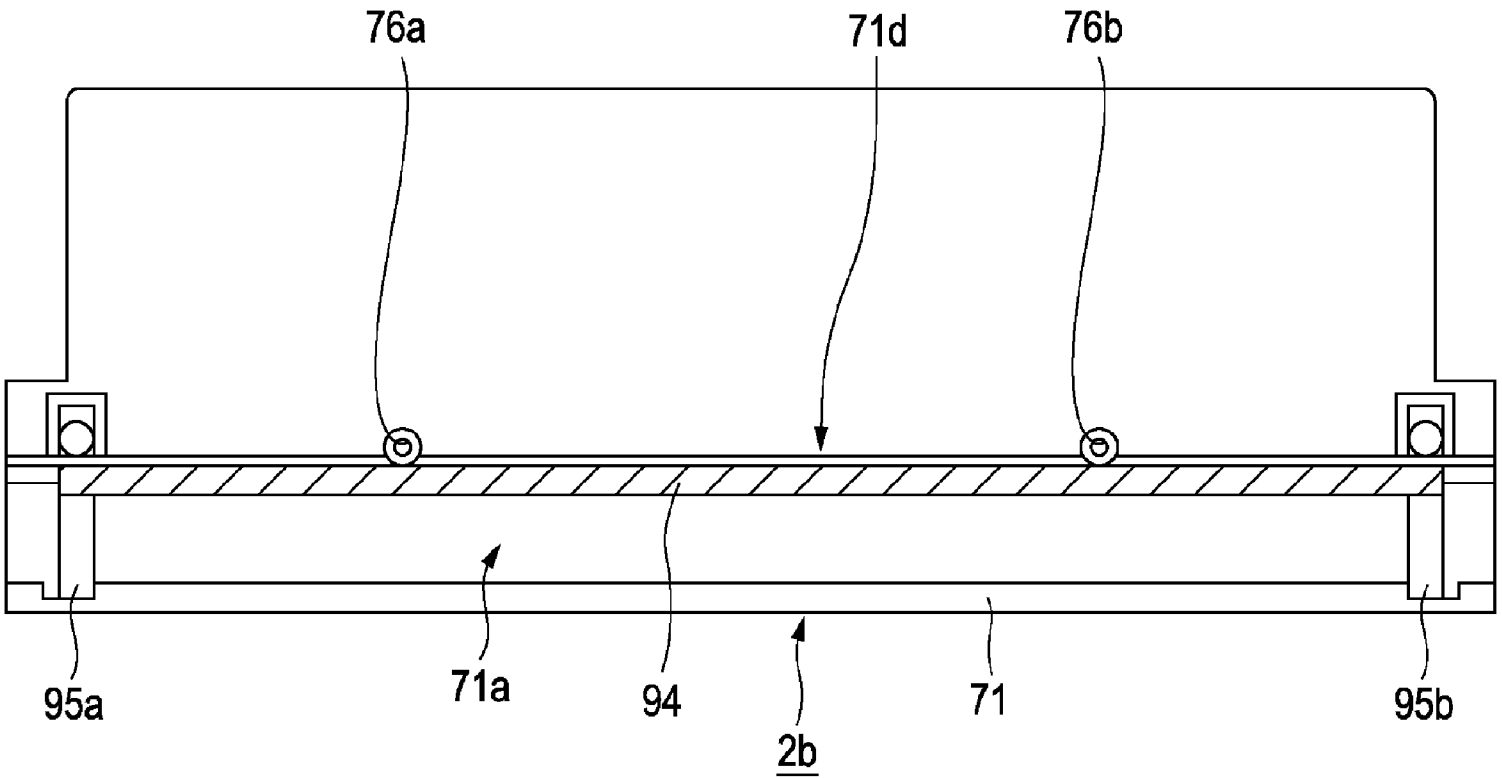
FIG. 8 is a schematic top view that illustrates a state after the development blade seal of the development unit is molded.

A seal configuration of the development unit 2*b* according to the first embodiment of the present invention is described below using FIGS. 4 to 8. FIG. 4 is a schematic cross-sectional view of the development unit 2*b*. FIG. 5 is a schematic front view that illustrates a state before the development blade seal 94 according to the first embodiment of the present invention is molded. FIG. 6 is a schematic top view that illustrates a state before the development blade seal 94 is molded. FIG. 7 is a schematic front view that illustrates a state after the development blade seal 94 is molded. FIG. 8 is a schematic top view that illustrates a state after the development blade seal 94 is molded.

As illustrated in FIGS. 4 to 8, the development chamber 71 has a development opening 71*a* for use in supplying toner accommodated in the toner container 70 to the development roller 22. The development roller 22 and the developer regulation member 73 configured to regulate the amount of toner on the development roller 22 are disposed in the vicinity of the development opening 71*a*. The developer regulation member 73 is the one in which a support plate 73*a* made of, for example, a steel plate and a development blade 73*b* made of, for example, a stainless-steel plate or a phosphor bronze plate are combined. The developer regulation member 73 is secured by screws to securing sections at both ends of the development chamber 71 and is supported thereon. Alternatively, the developer regulation member 73 may also be the one in which a support plate and a rubber element are integrally molded. End seal members 95*a* and 95*b* for sealing the gap between the development chamber 71 and the periphery of the development roller 22 are disposed at both ends of the development opening 71*a* in the longitudinal direction thereof. The end seal members 95*a* and 95*b* can be a flexible member having a surface covered with, for example, pile formed by woven felt or fibers or with electrostatic flocks and can maintain sufficient sealing capability by being pressed in contact with the peripheral surface of the development roller 22 and the back side of the developer regulation member 73.

Molding of Sealing Member

Figure 9:
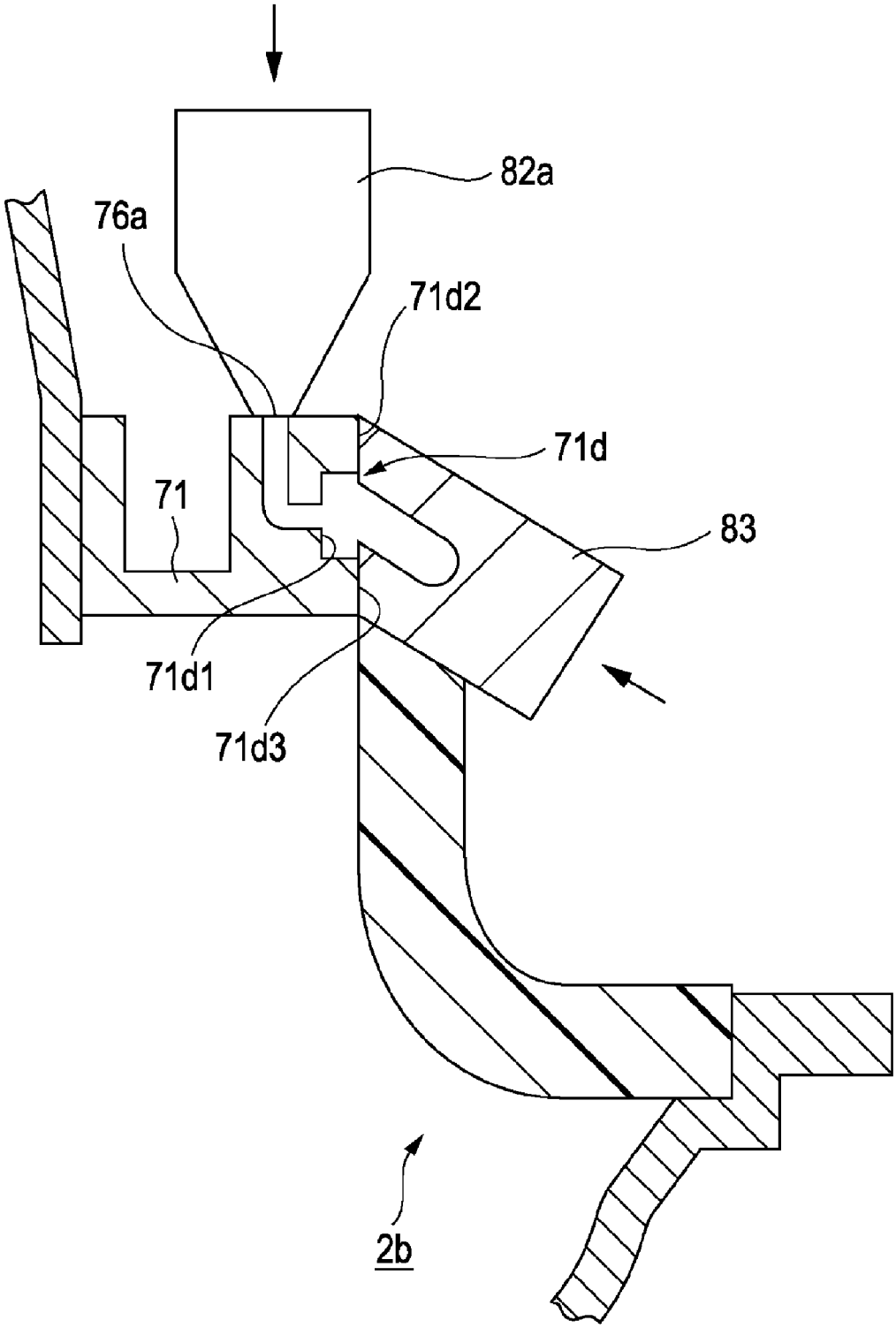
FIG. 9 is a schematic cross-sectional view of a polymer injection portion when a seal mold is clamped on the development unit.
Figure 10:
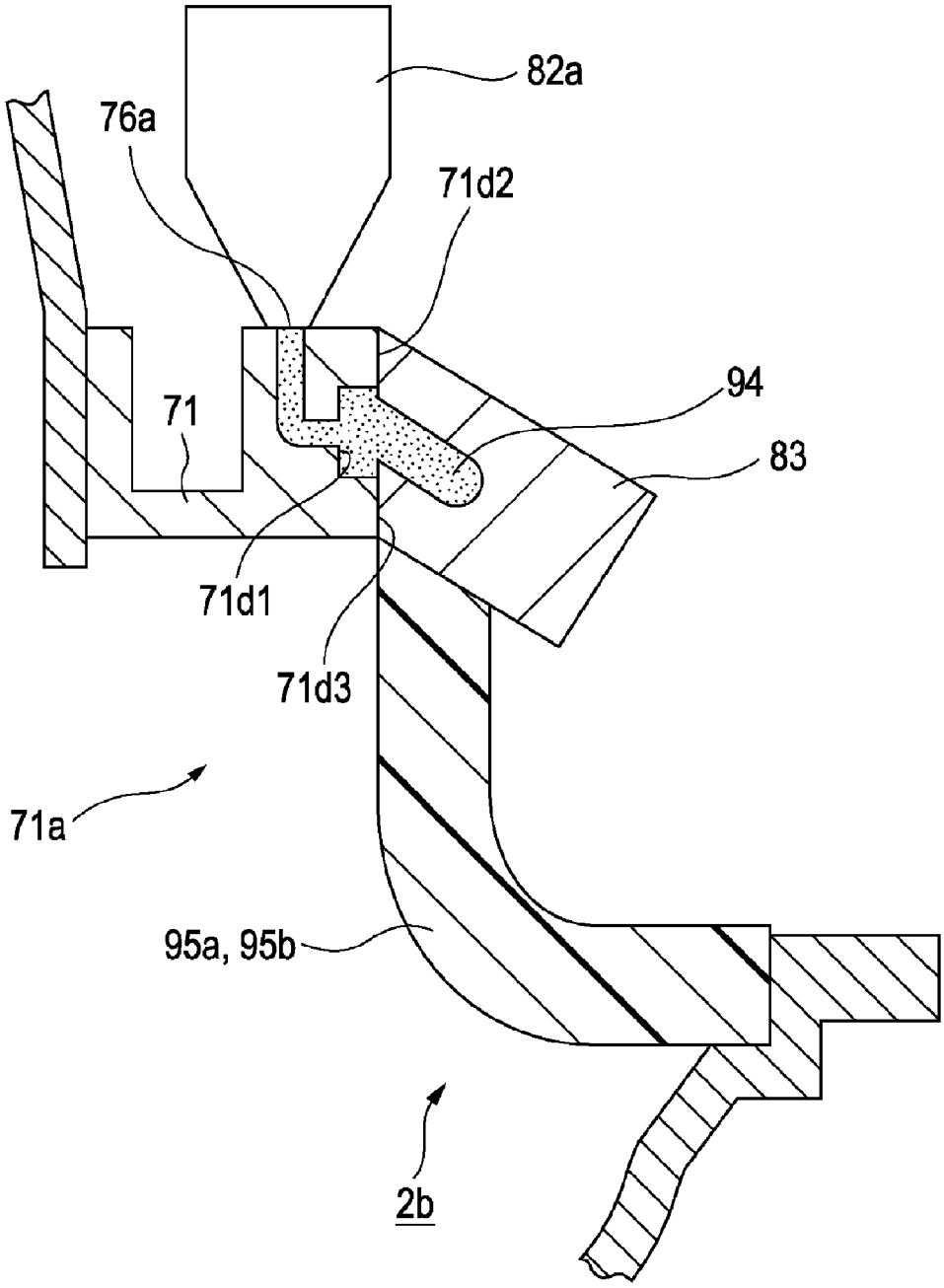
FIG. 10 is a schematic cross-sectional view that illustrates a state where the development blade seal is being molded on the development unit.
Figure 11:
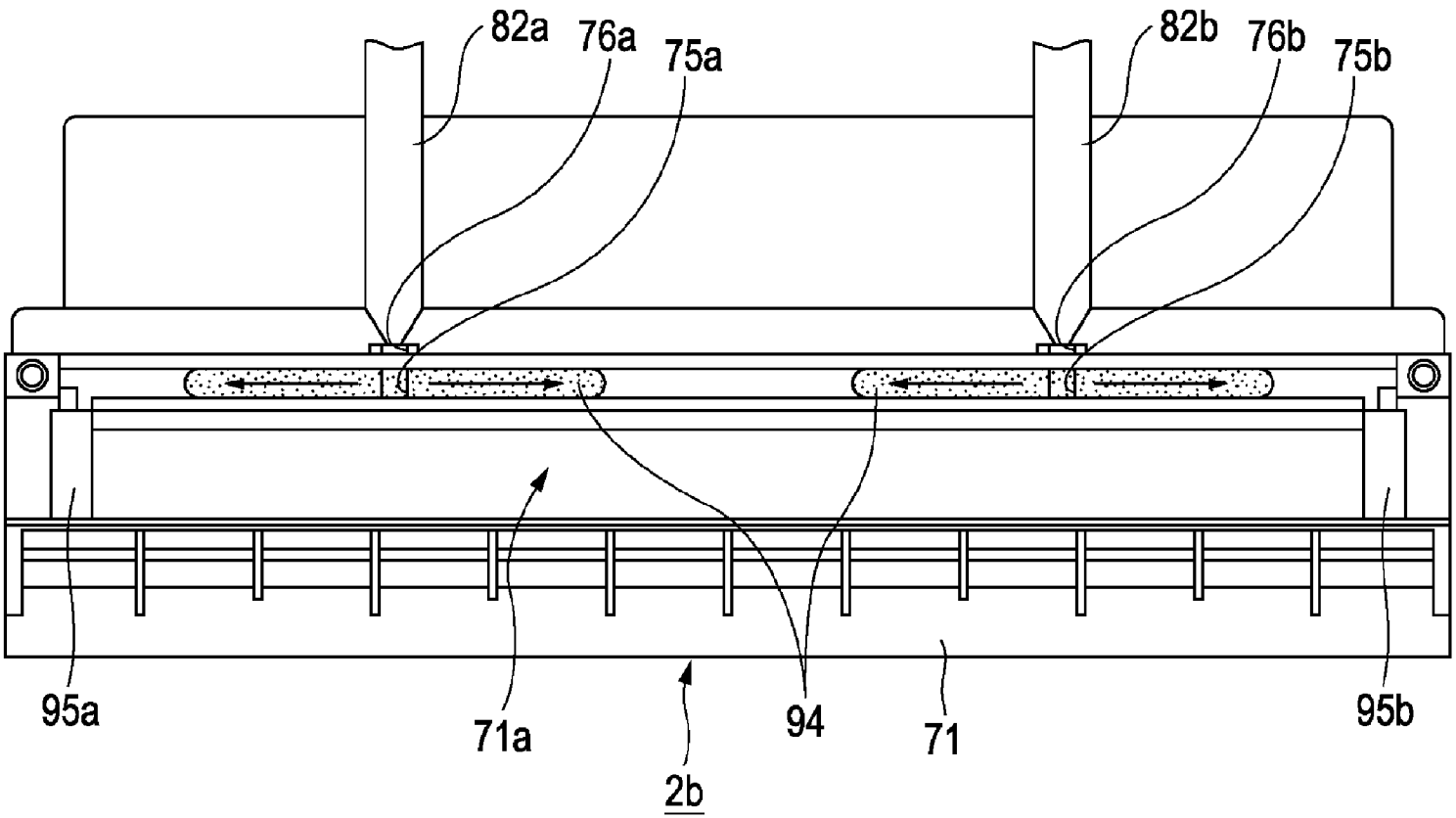
FIG. 11 is a schematic front view that illustrates a state where the development blade seal is being molded.

Next, a process for molding the development blade seal 94 is described using FIGS. 9 to 11. FIG. 9 is a schematic cross-sectional view of a polymer injection portion in a state where a seal mold 83 is clamped on the development unit 2*b* according to the first embodiment of the present invention. FIG. 10 is a schematic cross-sectional view that illustrates a state where the development blade seal 94 is being molded on the development unit 2*b* according to the first embodiment of the present invention. FIG. 11 is a schematic front view that illustrates a state where the development blade seal 94 is being molded according to the first embodiment of the present invention.

As illustrated in FIGS. 9 and 10, a seal forming portion 71*d* is disposed above the development opening 71*a* of the development chamber 71 and between the end seal member 95*a* at a first end and the end seal member 95*b* at a second end. The seal forming portion 71*d* includes a recess 71*d*1 for receiving an injected seal and contact surfaces 71*d*2 and 71*d*3 with which a mold can come into contact. Cylindrical inlets 76*a* and 76*b* communicating with the recess 71*d*1 of the seal forming portion 71*d* through holes 75*a* and 75*b* are disposed at predetermined locations in the longitudinal direction. In the present embodiment, as illustrated in FIG. 10, the inlets 76*a* and 76*b* are provided at two locations being remote from the center by substantially the same distance. However, other configuration can be applied. For example, an inlet may be provided at one location in a substantially central position in the longitudinal direction, or alternatively, inlets may be provided at three or more locations.

To mold the development blade seal 94, as illustrated in FIG. 9, the seal mold 83 dug so as to have the shape of a seal is made to come into contact with the contact surfaces 71*d*2 and 71*d*3 of the seal forming portion 71*d* of the development chamber 71. Then, gates 82*a* and 82*b* of a polymer injection device are made to come into contact with the inlets 76*a* and 76*b* disposed at two locations of the development chamber 71 in the longitudinal direction from above. When a thermoplastic elastomer to form the development blade seal 94 is injected into the inlets 76*a* and 76*b* of the development chamber 71 through the gates 82*a* and 82*b* of the polymer injection device, the thermoplastic elastomer is made to flow into a space formed by the recess 71*d*1 of the seal forming portion 71*d* of the development chamber 71 and the seal mold 83, as illustrated in FIG. 10. The thermoplastic elastomer injected from the two locations in the longitudinal direction flows toward both sides in the longitudinal direction within the space formed by the recess 71*d*1 of the seal forming portion 71*d* and the seal mold 83, as illustrated in FIG. 11. Other than the molding method described above, two-color molding or insert molding performed on the development chamber 71 may also be used in forming the sealing member.

In a related-art case in which a urethane foam is used as a sealing member, release paper of double-sided adhesive tape used in fixing the urethane foam to a container is present as discarded material. In contrast, with the present embodiment, a sealing member is molded on a development frame by use of a molding device having a hot-runner mechanism. Therefore, the occurrence of discarded material, such as release paper of double-sided adhesive tape, can be avoided.

Toner

Toner is described below. Toner used in the present invention is not limited to a particular one. For example, toner in which inorganic fine powder is externally added to toner particles containing a binder resin, a coloring agent, and a wax component can be suitably used. Examples of the binder resin forming the toner include a generally used styrene-acrylic copolymer, styrene-methacrylic copolymer, epoxy resin, and styrene-butadiene copolymer. Examples of the coloring agent forming the toner include organic pigment, organic dye, and inorganic pigment. It is useful that the coloring agent be used such that about 1 to 20 parts by mass of it is added to 100 parts by mass of a polymerizable monomer or binder resin. Examples of the wax component forming the toner include hydrocarbon wax. The wax component is used such that about 4.0 mass % to 25 mass % of it is added to the whole quantity of binder resin. Examples of the inorganic fine powder contained in the toner include silica fine powder, titanium oxide fine powder, alumina fine powder, and fine powder of composite oxide thereof.

Molecular Weight Characteristics and Measurement Conditions of Molecular Weight of Sealing Member A molecular weight distribution of a sealing member according to the first embodiment of the present invention is described. In the foregoing description, the sealing member is made of a thermoplastic elastomer that contains at least a copolymer and a plasticizer. In the molecular weight distribution of a tetrahydrofuran (THF) soluble matter of the thermoplastic elastomer measured by gel permeation chromatography (GPC), at least one peak is present in each of a region of a molecular weight of 4,000 or less and a region of a molecular weight of 30,000 to 200,000, and the percentage of a component of a molecular weight of 800 or less in a region of a molecular weight of 5,000 or less is 30% or less.

Next, a molecular weight distribution of a THF soluble matter of the thermoplastic elastomer and a method for measuring a molecular weight by gel permeation chromatography are described below. First, a thermoplastic elastomer was dissolved in THF at ambient temperature for about 24 hours. The obtained solution was filtered through a solvent resistance membrane filter having a pore diameter of about 0.2 μm "mai shori disuku" from Tosoh Corporation to obtain a sample solution. The sample solution is adjusted such that the concentration of a THF soluble matter is about 0.8 mass %. Using this sample solution, measurements were made under the conditions described below.

Column: TSK guard column Super H-H×1+TSK gel HM-M×2+TSK gel Super H2000×1 from Tosoh Corporation Eluent: Tetrahydrofuran (THF)

Detector: Differential refractometer (RI), Ultraviolet-visible detector (UV: 254 nm)

Oven temperature: 40.0° C.

Sample injection dose: 50 μl

To calculate the molecular weight of the sample, a molecular weight calibration curve generated using a standard polystyrene resin (for example, the trade name "TSK standard polystyrene F-850, F-450, F-288, F-128, F-80, F-40, F-20, F-10, F-4, F-2, F-1, A-5000, A-2500, A-1000, A-500" of Tosoh Corporation) was used.

Configuration of Developer Sealing Portion

Figure 12A:
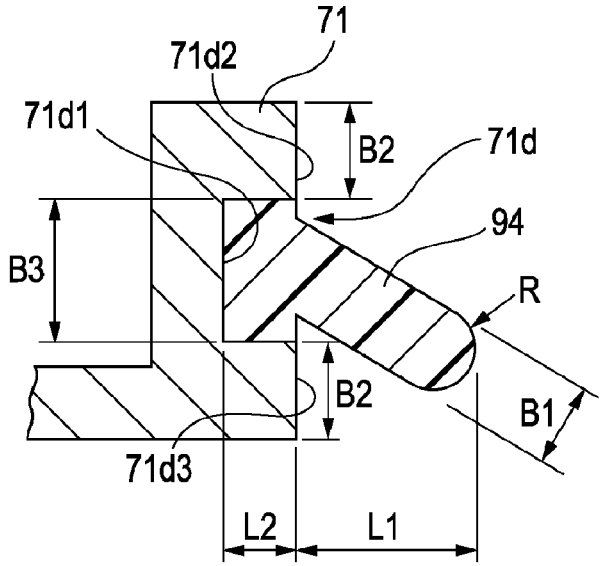
FIGS. 12A and 12B are schematic cross-sectional views that illustrate the development blade seal.

A configuration of a developer sealing portion for preventing leakage of a developer from a developer containing portion according to the first embodiment of the present invention is described below using FIGS. 12 and 13. One example configuration is illustrated in FIG. 12A. As illustrated in FIG. 12A, the sealing member (development blade seal 94) is disposed in the recess 71*d*1 of the seal forming portion 71*d* of the development chamber 71 and maintains sufficient sealing capability to prevent leakage of toner from between the development frame (development chamber 71) and the developer regulation member 73 to the outside of the development unit 2*b*. The development blade seal 94 has a cross section having a lip shape tapered to a seal contact surface of the developer regulation member 73. It is to be noted that "developer containing portion" in the present invention indicates a region in which a developer is held, so it indicates not only a toner container but also a development chamber. Because of this, the place into which a developer leaks may be a place inside a process cartridge where a developer does not exist originally.

Figure 12B:
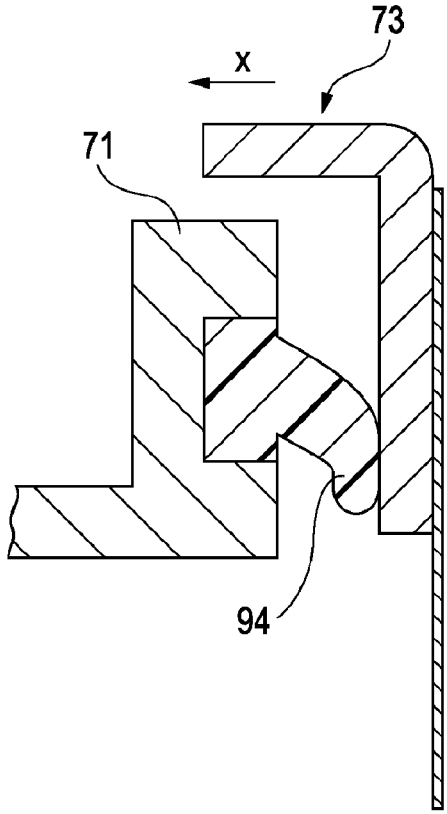

In a state where the developer regulation member 73 is attached to the development chamber 71, as illustrated in FIG. 12B, the development blade seal 94 is bent in the direction indicated by the arrow X between the development chamber 71 and the developer regulation member 73, thereby sealing to prevent leakage of toner. It is useful that the amount of bending of the development blade seal 94 in the direction indicated by the arrow X be set at approximately 0.3 to 1.8 mm in terms of sealing capability of the toner and resiliency to the developer regulation member 73. It is useful in terms of molding of a thermoplastic elastomer and dimensional accuracy of the development chamber 71 that the lip height L1 of the development blade seal 94 be 2.0 to 4.0 mm, the lip width B1 be 1.0 to 2.5 mm, the width B3 of the recess 71*d*1 be 1.5 to 2.0 mm, and the depth L2 of the recess 71*d*1 be 0.5 to 2.0 mm.

Figure 13A:
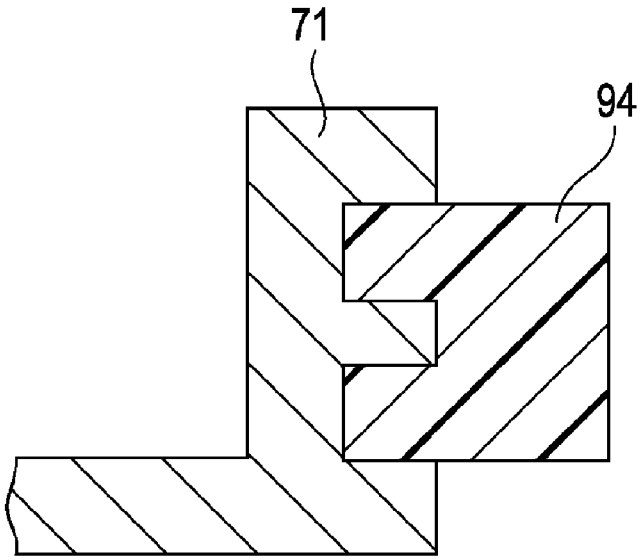
FIGS. 13A and 13B are cross-sectional views that illustrate other forms of the development blade seal.
Figure 13B:
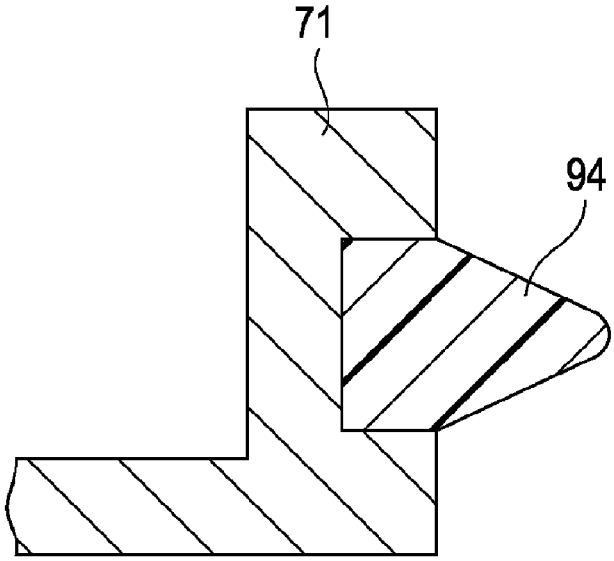

As illustrated in FIGS. 13A and 13B, the development blade seal 94 can be molded even when its cross section is made to exhibit a polygonal shape (FIG. 13A) or a triangular shape (FIG. 13B) and then it is pressed and deformed by a predetermined depression quantity. However, in the case of the configuration illustrated in FIG. 13, a rise in the resiliency to the developer regulation member 73 with an increase in the depression quantity in the direction indicated by the arrow X is larger than that of the configuration illustrated in FIG. 12, which has a bent deformation. Therefore, as illustrated in FIG. 12, the present embodiment has a configuration in which the development blade seal 94 is bent in a lip shape to minimize the resiliency of to the developer regulation member 73. In a molecular weight distribution of a THF soluble matter of the thermoplastic elastomer measured by GPC, at least one peak is present in each of a region of a molecular weight of 4,000 or less, and a region of a molecular weight of 30,000 to 200,000 and the percentage of a component of a molecular weight of 800 or less in a region of a molecular weight of 5,000 or less is 30% or less.

In the above molecular weight distribution, when a peak is present in each of the region of a molecular weight of 4,000 or less and the region of a molecular weight of 30,000 to 200,000, the resilience of the sealing member is appropriate, and good sealing capability can be maintained without deformation of the development chamber 71 and the developer regulation member 73. Additionally, resistance to creep phenomena is high, and the good sealing capability can be maintained for a long time. The major portion of a component of a molecular weight of 5,000 or less is considered to be result from a plasticizer. In particular, because a component of a molecular weight of 800 or less is apt to seep and greatly affects toner, it is desired that the content thereof be small. Thus, in the above molecular weight distribution, when the percentage of the component of a molecular weight of 800 or less in a region of a molecular weight of 5,000 or less is 30% or less, the effects of seeping of the plasticizer can be reduced to a degree of no problem. It is useful that the percentage of this component be 10% or less. In the above molecular weight distribution, if a peak is absent in the region of a molecular weight of 30,000 to 200,000 and a peak is present in the region exceeding a molecular weight of 200,000, the hardness of the entire sealing member increases and the resilience of the sealing member enhances, so the development chamber 71 and the developer regulation member 73 are apt to be deformed. If a peak is absent in the region of a molecular weight of 4,000 or less and a peak is present in the region exceeding a molecular weight of 4,000, the molecular weight of the plasticizer is assumed to be too high and sufficient plasticizing effects are not obtainable, the resilience of the sealing member is high and the development chamber 71 and the developer regulation member 73 are apt to be deformed. Additionally, because viscosity of the resin increases and the molding capability decreases, in order to mold a thermoplastic elastomer in all over the longitudinal direction, it is necessary to have large quantities of the height L1 of the sealing member (development blade seal 94), the lip width B1, the width B3 of the recess 71*d*1, and the depth L2 of the recess 71*d*1. This results in an increased cost caused by an increase in the amount of materials used and an increased space.

In the above molecular weight distribution, if a peak is absent in the region exceeding a molecular weight of 30,000 and a peak is present in the region less than a molecular weight of 30,000 resistance to creep phenomena of the thermoplastic elastomer itself decreases. Therefore, if a sealing member is left under an environment of a temperature of approximately 50° C. for one month or more, because creep deformation of the sealing member advances, the sealing capability for toner deteriorates.

In the above molecular weight distribution, in the case where the percentage of a component of a molecular weight of 800 or less in the region of a molecular weight of 5,000 or less exceeds 30%, if the sealing member is left under an environment of an approximately 50° C. for two weeks or more, the plasticizer contained in the thermoplastic elastomer seeps. If the plasticizer seeps, toner particles are fused together, so an image defect, such as a vertical line, occurs.

It is useful that a styrene-based elastomer is used as the thermoplastic elastomer. In most cases, high-impact polystyrene (HI-PS) is used as the development chamber. When a styrene-based elastomer is used as the sealing member, both of the sealing member and the development chamber are made of a styrene-based material, so adhesion when the sealing member is directly molded on the development chamber is high. In addition, because both are made of a styrene-based material, the necessity of separation in recycling can be eliminated. It is useful that a copolymer having a polystyrene block (10 to 40 mass %) and an elastomer block (60 to 90 mass %) be used as the styrene-based elastomer. It is useful that refined paraffin oil be used as the plasticizer to be contained. In this case, it is useful that the percentage of the plasticizer in the thermoplastic elastomer be 60 to 80 mass %. It is useful that the amount of a THF insoluble matter of the thermoplastic elastomer is a molecular weight of 5 mass % to 30 mass % because appropriate resilience is obtainable. It is more useful that the amount of the THF insoluble matter of the thermoplastic elastomer is a molecular weight of 7 to 20 mass %.

Examples 1-5 and Comparative Examples 1-5

A development blade seal was molded using a molding apparatus having a hot-runner mechanism, as illustrated in FIGS. 9 to 11. Loading into a mold was performed while being heated at approximately 180° C. In Example 1, as a thermoplastic elastomer forming the sealing member, one composed of a copolymer having 25 mass % of a polystyrene block and 75 mass % of an elastomer block and refined paraffin oil (plasticizer) was used. The percentage of the plasticizer in the thermoplastic elastomer was 75 mass %, and the amount of a THF insoluble matter of the thermoplastic elastomer was 12 mass %.

Results of an analysis and evaluation of the thermoplastic elastomer used in the present example are shown in Table 1. Examples 2 to 5 and Comparative Examples 1 to 5 had substantially the same prescription and used respective adjusted molecular weights. In Table 1, Ex1 to Ex5 indicate Example 1 to Example 5, respectively, and C.EX1 to C.EX5 indicate Comparative Example 1 to Comparative Example 5, respectively. In Examples 1 to 5 and Comparative Examples 1 to 5 in Table 1, an evaluation method for use in each "creep of sealing member," "line in image," and "deformation in peripheral member" is described below.

Creep of Sealing Member: After the sealing member was left in an environment of approximately 40° C. and 95% RH (high temperature and high humidity) for 30 days, the degree of change in the lip height L1 of the development blade seal 94 was observed and evaluated.

Line in Image: After 23,000 prints of an image having a one percent page-coverage rate were continuously output in each an environment of approximately 23° C. and 55% RH (standard temperature and standard humidity) and an environment of approximately 30° C. and 80% RH (high temperature and high humidity), the presence/absence of a line in the image was evaluated.

Deformation of Peripheral Member: Deformation in the developer regulation member with which the development blade seal is in contact was visually checked and evaluated.

TABLE 1

| | Molecular Weight Distribution of THF Soluble Matter | | | | | | |
|---|---|---|---|---|---|---|---|
| | Low Molecular Weight Side | High Molecular Weight Side | Percentage of Component of Molecular Weight (%) | Content of THF Insoluble Matter (mass %) | Creep of Sealing Member | Line in Image | Deformation of Peripheral Member |
| Ex 1 | 1,700 | 110,000 | 4.0 | 12 | no problem | no problem | no problem |
| Ex 2 | 2,100 | 100,000 | 2.0 | 11 | no problem | no problem | no problem |
| Ex 3 | 1,400 | 100,000 | 10.0 | 10 | no problem | no problem | no problem |
| Ex 4 | 1,200 | 100,000 | 28.0 | 8 | no problem | slightly occurred | no problem |
| Ex 5 | 1,700 | 70,000 | 3.0 | 9 | no problem | no problem | no problem |
| C. Ex 1 | 5,000 | 100,000 | 0.5 | 15 | no problem | no problem | occurred |
| C. Ex 2 | 800 | 100,000 | 35.0 | 7 | no problem | occurred | no problem |
| C. Ex 3 | 400 | 100,000 | 60.0 | 6 | no problem | occurred | no problem |
| C. Ex 4 | 1,700 | 220,000 | 3.0 | 27 | no problem | no problem | occurred |
| C. Ex 5 | 1,700 | 20,000 | 3.0 | 3 | occurred | no problem | no problem |

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-316881 filed Dec. 12, 2008, which is hereby incorporated by reference herein in its entirety.

What is claimed is:

1. A sealing member for preventing leakage of a developer from a developer containing portion of a process cartridge detachable from a main body of an electrophotographic image forming apparatus to an outside of the developer containing portion, wherein the sealing member is made of a thermoplastic elastomer that contains at least a copolymer and a plasticizer, and in a molecular weight distribution of a tetrahydrofuran soluble matter of the thermoplastic elastomer measured by gel permeation chromatography, at least one peak is present in each of a region of a molecular weight of 4,000 or less and a region of a molecular weight of 30,000 to 200,000, and a percentage of a component of a molecular weight of 800 or less in a region of a molecular weight of 5,000 or less is 30% or less.

2. The sealing member according to claim 1, wherein the percentage of the component of a molecular weight of 800 or less in the region of a molecular weight of 5,000 or less is 10% or less.

3. The sealing member according to claim 1, wherein the sealing member is a member configured to prevent leakage of the developer from between a developer regulation member and a development frame, the developer regulation member being configured to regulate a thickness of the developer on a developer bearing member.

4. A process cartridge detachable from a main body of an electrophotographic image forming apparatus, the process cartridge comprising:

a developer containing portion; and a sealing member for preventing leakage of a developer from the developer containing portion to an outside of the developer containing portion, wherein the sealing member is made of a thermoplastic elastomer that contains at least a copolymer and a plasticizer, and in a molecular weight distribution of a tetrahydrofuran soluble matter of the thermoplastic elastomer measured by gel permeation chromatography, at least one peak is present in each of a region of a molecular weight of 4,000 or less and a region of a molecular weight of 30,000 to 200,000, and a percentage of a component of a molecular weight of 800 or less in a region of a molecular weight of 5,000 or less is 30% or less.

5. The process cartridge according to claim 4, wherein the percentage of the component of a molecular weight of 800 or less in the region of a molecular weight of 5,000 or less is 10% or less.

6. The process cartridge according to claim 4, wherein the sealing member is a member configured to prevent leakage of the developer from between a developer regulation member and a development frame, the developer regulation member being configured to regulate a thickness of the developer on a developer bearing member.

* * * * *